US005215486A

United States Patent [19]

Rizikow

[11] Patent Number: 5,215,486

[45] Date of Patent: Jun. 1, 1993

[54] DUAL PROPELLER OUT BOARD ASSEMBLY

[76] Inventor: Mauricio Rizikow, One Chatsworth Pl., Farmington, Conn. 06032

[21] Appl. No.: 904,035

[22] Filed: Jun. 25, 1992

[51] Int. Cl.[5] ..... B63H 5/06

[52] U.S. Cl. ..... 440/79; 440/900; 440/75

[58] Field of Search ..... 440/79, 80, 900, 82, 440/77, 75, 111, 112

[56] References Cited

U.S. PATENT DOCUMENTS

| | | | |
|---|---|---|---|
| 1,707,897 | 4/1929 | Bizet | 440/79 |
| 2,371,013 | 3/1945 | Wosenitz | 440/75 |
| 2,691,954 | 10/1954 | Shively | 440/79 |
| 2,936,730 | 5/1960 | Patty, Jr. | 440/79 |
| 2,999,476 | 9/1961 | Johnson | 440/79 |

FOREIGN PATENT DOCUMENTS

| | | | |
|---|---|---|---|
| 616755 | 9/1959 | Italy | 440/53 |

*Primary Examiner*—Edwin L. Swinehart

*Attorney, Agent, or Firm*—Malloy & Malloy

[57] ABSTRACT

A dual propeller outboard assembly to be used on a marine vessel so as to provide a pair of independent propeller drives, driven by a single motor, the assembly including a motor, a primary drive shaft drivingly connected with the motor, a first and second secondary drive shafts positioned in substantially spaced apart relation from one another and drivingly interconnected with the single primary drive shaft such that a universal gear positioned at a distal end of each of the secondary drive shafts will correspondingly engage a first and a second propulsion shaft having a propeller assembly thereon to drive the vessel through the water.

3 Claims, 1 Drawing Sheet

DUAL PROPELLER OUT BOARD ASSEMBLY

BACKGROUND OF THE INVENTION

1. Field of the Invention

This invention relates to a dual propeller outboard assembly, to be used on marine vessels so as to maximize the propulsion rate possible with a single motor, thereby increasing the speed capability of the vessel without increasing the rate of fuel consumption.

2. Description of the Prior Art

Outboard motors are a common drive mechanism utilized in many marine vessels. Unfortunately, as with most motors, they consume large quantities of fuel and have limited drive capability. For this reason, many large vessels often utilize two outboard motors, which while doubling the drive power also doubles the rate of fuel consumption and substantially increases the weight carried by the vessel. As a result, it would be highly beneficial to provide an outboard propulsion system which can substantially increase the drive potential of an engine without causing a corresponding increase in fuel consumption and without necessitating the added weight of a second motor on the vessel.

In the past, there have been dual propeller assemblies, such as those recited in the patents to W. C. Conover, U.S. Pat. No. 2,672,115, and Brandt, U.S. Pat. No. 4,529,387, which have utilized two propellers to increase the drive potential of the motor. These assemblies, however, utilize two propellers mounted in line with one another on the same propulsion shaft, thereby acting more like a single larger propeller than a pair of spaced, independent propeller assemblies which are disposed to function much like two separate outboards mounted in spaced apart relation from one another on the marine vessel. Further, propeller drives such as the one recited in the patent to Billing, U.S. Pat. No. 2,372,247, while separating the propellers are directed towards minimizing hydraulic torque and not to increasing the drive potential of the motor. The present invention specifically provides a pair of spaced independent propeller assemblies which function together to increase the drive potential of a single motor having a single drive shaft. Also, by providing a large drive gear to small secondary gear ratio, the power output in terms of revolutions per minute is effectively increased to further maximize the drive potential of the assembly.

SUMMARY OF THE INVENTION

The present invention is directed towards a dual propeller outboard assembly to be used on a marine vessel so as to enable the vessel to be propelled at substantially the same speed as it would be propelled utilizing two separate outboard motors. The assembly primarily includes a single motor having a primary drive shaft drivingly connected thereto. Additionally, there is a first secondary drive shaft and a second secondary drive shaft positioned in substantially spaced apart relation from one another, and spaced from the primary drive shaft. These secondary drive shafts are each independently and drivingly interconnected with the single primary drive shaft, by drive means, such that when the primary drive shaft is turned, the secondary drive shafts are correspondingly turned. Positioned at a distal end of each of the secondary drive shafts is a universal gear. The universal gear on each of the secondary drive shafts is positioned so as to enable corresponding driving of a first propulsion shaft and a second propulsion shaft, each perpendicularly disposed with relation to the corresponding secondary drive shaft. The propulsion shafts, each of which includes a proximal end and a distal end have propulsion means at their distal end. The propulsion means which propel the marine vessel through the water include a propeller assembly, each of the propulsion shafts including its own propeller assembly, drivingly connected at its distal end.

It is an object of the present invention to provide a dual propeller outboard assembly which will effectively enable a marine vessel to run at greater speeds, such as those capable with two outboard motors, without necessitating increased power from the single motor or increasing the fuel consumption of the motor.

Still another object of the present invention is to provide a dual propeller outboard assembly which will provide for a step up in revolutions per minute capable by the motor as a result of the configuration of the drive gears.

A further object of the present invention is to provide a dual propeller outboard assembly which provides two independent propeller assemblies which provide an increased aggregate drive potential.

BRIEF DESCRIPTION OF THE DRAWINGS

For a fuller understanding of the nature of the present invention, reference should be had to the following detailed description taken in combination with the accompanying drawings in which.

Like reference numerals refer to like parts throughout the several views of the drawings.

DETAILED DESCRIPTION OF THE PREFERRED EMBODIMENT

Figure 1:
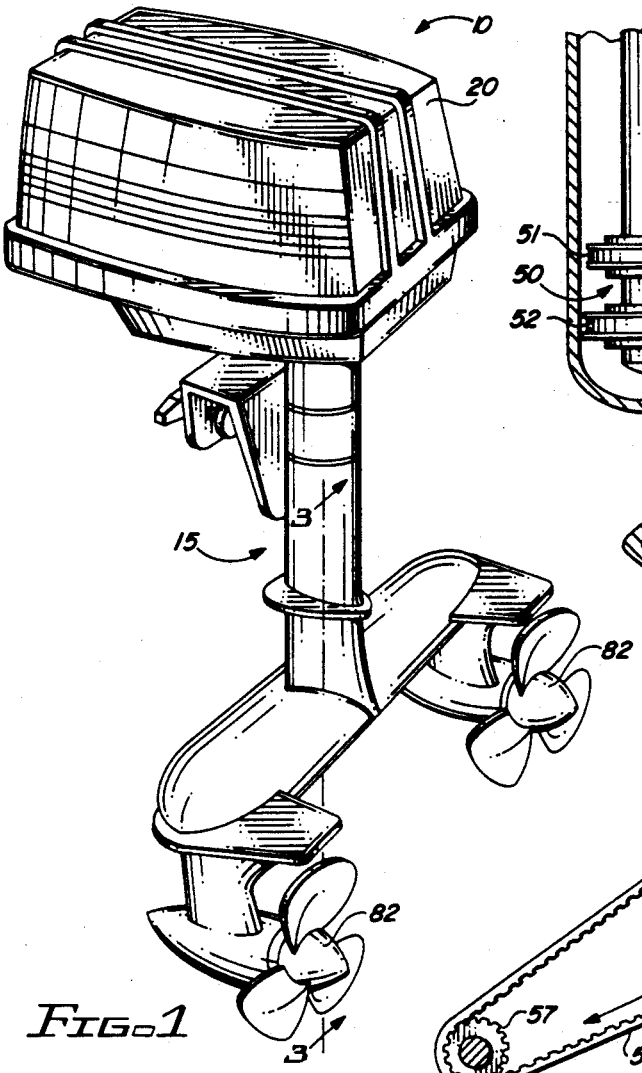
FIG. 1 is a perspective of the dual propeller outboard assembly.
Figure 3:
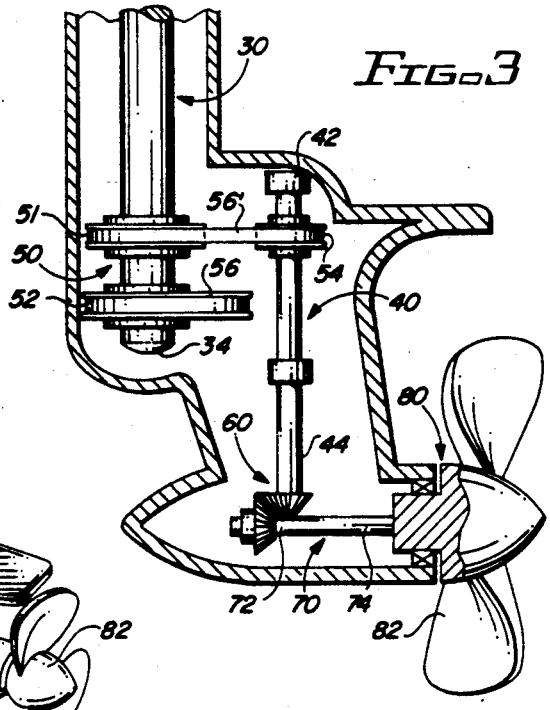
FIG. 3 is a partial cross-sectional view along line 3—3 of FIG. 1.

As shown throughout FIGS. 1-5, the present invention is directed towards a dual propeller outboard assembly, generally indicated as 10, to be used on a marine vessel. As shown in FIG. 1, this dual outboard assembly 10 includes a single motor 20, and much like the standard outboard motors includes a lightweight housing 15 to contain the internal portions of the assembly 10. The single motor 20 is adapted to drive a pair of spaced propellers 82 so as to provide the propulsive force of a pair of independent outboard motors.

Figure 2:
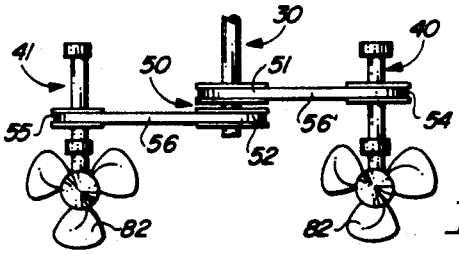
FIG. 2 is an isolated plan view of the shaft assembly of the present invention.
Figure 5:
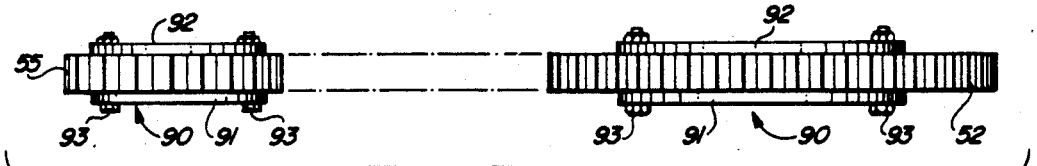
FIG. 5 is a side view of the drive means of the present invention, illustrating the mounting means.

Turning to FIGS. 1 and 2, the outboard assembly 10 includes a primary drive shaft 30 which is driven by the motor 20. Further, positioned in spaced apart relation from one another, and from the primary drive shaft 30 are a first secondary drive shaft 40 and a second secondary drive shaft 41. These secondary drive shafts 40 and 41 are drivingly interconnected with the primary drive shaft 30 by drive means 50, discussed in detail hereafter. The secondary drive shaft 40 and 41, which are generally in parallel relation with one another and the primary drive shaft 30 have a universal gear 60 positioned at a distal end 44 thereof. This universal gear 60 functions to enable the driving force of the secondary drive shafts 40 and 41 to be correspondingly transferred to a perpendicularly oriented propulsion shaft 70. There is a first propulsion shaft and a second propulsion shaft, each shaft correspondingly engaged with the first secondary drive shaft 40 or second secondary drive shaft 41. Each of the propulsion shafts 70, which are driven at their proximal end by the universal gears 60, include propulsion means 80 at their distal end 74. These propulsion means 80, which in the preferred embodiment are a propeller assembly, protrude from the housing 15 such that the propeller 82 is exposed.

Figure 4:
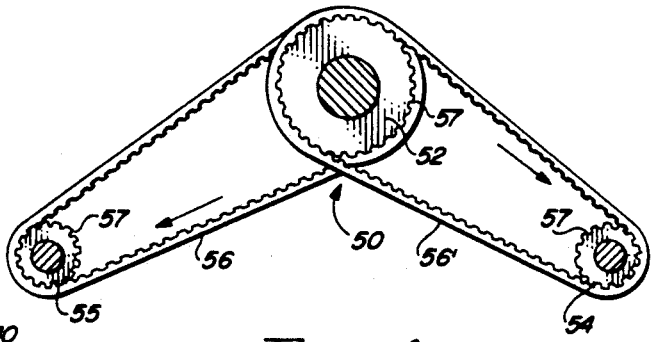
FIG. 4 is a bottom plan view of the drive means of the present invention.

The drive means 50 of the outboard assembly 10 includes a pair of primary drive gears 51 and 52 mounted near a distal end 34 of the primary drive shaft 30. The primary drive gears 51 and 52 are correspondingly engaged with a first secondary drive gear 54 and a second secondary drive gear 55, respectively. These secondary drive gears 54 and 55 are secured near a proximal end 42 of the first secondary drive shaft 40 and second secondary drive shaft 41, respectively. As detailed in FIG. 4, the primary drive gears 51 and 52 are interconnected with the secondary drive gears 54 and 55 by a pair of drive chains 56 and 56'. In the preferred embodiment, each of the primary drive gears 51 and 52 and secondary drive gears 54 and 55 include a plurality of teeth 57 about a periphery thereof such that a drive chains 56 and 56' may be drivingly engaged. Alternatively, drive belts may be equivalently utilized. Additionally, as best seen in FIG. 4, the primary drive gears 51 and 52 are substantially larger than the secondary drive gears 54 and 55 such that a single turn of the primary drive gears 51 and 52 will result in multiple turns of the secondary drive gears 54 and 55. Accordingly, the RPM's resulting at the secondary drive gears 54 and 55 are much greater than those resulting from the primary drive gears 51 and 52, without necessitating the motor 20 to increase the RPM's of the drive shaft 30.

In order to securely mount the primary drive gears 51 and 52 and secondary drive gears 54 and 55 to the primary drive shaft 30 and secondary drive shafts 40 and 41, respectively, mounting means 90 are bolted through the primary drive gears 51 and 52 and secondary drive gears 54 and 55. The mounting means 90, as best detailed in FIG. 5, include a pair of mounting brackets 91 and 92 and a pair of bolts 93 passing therethrough so as to provide a compressing force which secures the gears 51, 52, 54 and 55 correspondingly to the drive shafts 30, 40 and 41.

The present illustration is the preferred embodiment of the present invention, a primary purpose of which is to provide a pair of separate propellers 82 to drive a marine vessel, while only requiring a single motor 20 and not requiring an increased fuel consumption to drive both propellers 82.

It should be noted that variations on this preferred embodiment which are consistent with the invention as claimed and the doctrine of equivalents, should also be included.

Now that the invention has been described,

What is claimed is:

1. For use on a marine vessel, a dual propeller outboard assembly comprising:

a motor a primary drive shaft, drivingly connected with said motor, a first secondary drive shaft and a second secondary drive shaft, positioned in substantially spaced apart, parallel relation from one another, drive means structured and disposed to drivingly and independently interconnect each of said secondary drive shafts with said primary drive shaft, said drive means including a pair of primary drive gears, drivingly mounted in spaced apart relation from one another near a distal end, opposite said motor, of said primary drive shaft, said drive means further including a first secondary drive gear drivingly mounted at a proximal end of said secondary drive shaft, and a second secondary drive gear drivingly mounted at a proximal end of said second secondary drive shaft, each of said first secondary drive gear and said second secondary drive gear be independently interconnected with one of said pair of primary drive gears on said primary drive shaft, said primary drive gears being generally larger in diameter than said secondary drive gears such that one revolution of said primary drive gears results in multiple revolutions of said secondary drive gears, said primary drive gears and said secondary drive gears including a plurality of teeth about a periphery thereof, said teeth being structured and disposed to engage one of a pair of multi-link drive chains, each of said drive chains drivingly interconnecting one of said primary drive gears with one of said secondary drive gears, a universal gear positioned at a distal end of each of said secondary drive shafts, a first propulsion shaft and a second propulsion shaft, each propulsion shaft including a proximal end and a distal end, said proximal end of each of said propulsion shafts being drivingly interconnected with a corresponding one of said universal gears at a distal end of said secondary drive shafts, propulsion means at said distal end of each of said propulsion shafts, said propulsion means being structured and disposed to propel the marine vessel through the water, and said propulsion means including a propeller assembly.

2. An assembly as in claim 1 wherein said assembly includes mounting means structured and disposed to correspondingly secure said primary drive gears and said secondary drive gears to said primary drive shaft and said secondary drive shafts, said mounting means each including a pair of mounting brackets bolted to one another.

3. An assembly as in claim 2 wherein said assembly further includes a lightweight, impact resistant housing.

* * * * *